US007585128B2

(12) United States Patent
Hall et al.

(10) Patent No.: US 7,585,128 B2
(45) Date of Patent: Sep. 8, 2009

(54) METHOD FOR ADDING FOAMING AGENTS TO PAVEMENT AGGREGATE

(76) Inventors: David R. Hall, 2185 S. Larsen Pkwy., Provo, UT (US) 84606; Codrin Daranga, 2185 S. Larsen Pkwy., Provo, UT (US) 84606

( * ) Notice: Subject to any disclaimer, the term of this patent is extended or adjusted under 35 U.S.C. 154(b) by 435 days.

(21) Appl. No.: 11/674,546

(22) Filed: Feb. 13, 2007

(65) Prior Publication Data

US 2008/0193214 A1 Aug. 14, 2008

(51) Int. Cl.
*E01C 7/35* (2006.01)

(52) U.S. Cl. ..... 404/75; 427/138

(58) Field of Classification Search ..... 404/75, 404/77, 90, 95, 108; 427/136, 138
See application file for complete search history.

(56) References Cited

U.S. PATENT DOCUMENTS

| | | | | |
|---|---|---|---|---|
| 1,887,341 | A | | 11/1932 | Venabie |
| 1,898,158 | A | | 2/1933 | Winkle |
| 2,039,078 | A | | 4/1936 | Hartwig |
| 2,098,895 | A | | 11/1937 | Velten |
| 2,633,782 | A | | 4/1953 | Clement |
| 2,893,299 | A | | 7/1959 | Moir |
| 2,908,206 | A | | 10/1959 | Melanson |
| 2,917,395 | A | * | 12/1959 | Csanyi ..... 106/122 |
| 2,938,438 | A | | 5/1960 | Hamilton |
| 3,075,436 | A | | 1/1963 | McRae |
| 3,361,042 | A | | 1/1968 | Cutler |
| 3,732,023 | A | | 5/1973 | Rank |
| 3,817,644 | A | | 6/1974 | Matson |
| 3,970,404 | A | | 7/1976 | Benedetti |
| 3,989,401 | A | | 11/1976 | Moench |
| 4,018,540 | A | | 4/1977 | Jackson |
| 4,104,736 | A | | 8/1978 | Mendenhall |
| 4,124,325 | A | | 11/1978 | Cutler |
| 4,127,351 | A | | 11/1978 | Vural |
| 4,172,679 | A | | 10/1979 | Wirtgen |
| 4,195,946 | A | | 4/1980 | Swisher |
| 4,215,940 | A | | 8/1980 | Gabriel |
| 4,256,734 | A | * | 3/1981 | Smadja ..... 427/139 |
| 4,261,669 | A | | 4/1981 | Edo |
| 4,313,690 | A | | 2/1982 | Hojbjerg |
| 4,335,975 | A | | 6/1982 | Schoelkopf |
| 4,347,016 | A | | 8/1982 | Sindelar et al. |
| 4,407,605 | A | | 10/1983 | Wirtgen |
| 4,473,320 | A | | 9/1984 | Register |
| 4,534,674 | A | | 8/1985 | Cutler |
| 4,594,022 | A | | 6/1986 | Jeppson |
| 4,668,017 | A | | 5/1987 | Peterson |
| 4,676,689 | A | | 6/1987 | Yant |
| 4,692,350 | A | * | 9/1987 | Clarke et al. ..... 427/138 |
| 4,784,518 | A | | 11/1988 | Cutler |

(Continued)

*Primary Examiner*—Gary S Hartmann
(74) *Attorney, Agent, or Firm*—Tyson J. Wilde; Jad A. Mills

(57) ABSTRACT

In one aspect of the invention, a method for reconditioning a paved surface includes the steps of providing a vehicle adapted to traverse the paved surface; providing a layer of loose aggregate on an underlayer by degrading the paved surface with a degradation element attached to the vehicle; adding a foaming agent to the layer of loose aggregate on the underlayer; and coating a total aggregate surface area by mixing hot asphalt into the loose aggregate and allowing the foaming agent to expand the asphalt.

19 Claims, 8 Drawing Sheets

U.S. PATENT DOCUMENTS 4,793,730 A 12/1988 Butch
4,968,101 A 11/1990 Bossow
5,026,205 A 6/1991 Gorski
5,131,788 A 7/1992 Hulicsko
5,366,320 A 11/1994 Hanlon
5,486,554 A * 1/1996 Truax ..... 524/71
5,556,225 A 9/1996 Marino
5,765,926 A 6/1998 Knapp
5,791,814 A 8/1998 Wiley
5,827,360 A * 10/1998 Salminen ..... 106/273.1
5,947,636 A 9/1999 Mara
5,947,638 A 9/1999 Heims
5,951,561 A 9/1999 Pepper
5,971,657 A * 10/1999 Medico et al. ..... 404/92
6,122,601 A 9/2000 Swanson
6,158,920 A 12/2000 Malot
6,287,048 B1 9/2001 Hollon
6,371,689 B1 4/2002 Wiley
6,551,018 B2 4/2003 Baker
6,577,141 B2 6/2003 Gandrud
6,623,207 B2 9/2003 Grubba
6,769,836 B2 8/2004 Lloyd
6,799,922 B2 10/2004 Smith
6,846,354 B2 * 1/2005 Larsen et al. ..... 106/122
7,223,049 B2 * 5/2007 Hall et al. ..... 404/93
7,473,052 B2 * 1/2009 Hall et al. ..... 404/75
7,544,011 B2 * 6/2009 Hall et al. ..... 404/111
7,549,821 B2 * 6/2009 Hall et al. ..... 404/75
2006/0198698 A1 * 9/2006 Hall et al. ..... 404/75
2006/0204331 A1 * 9/2006 Hall et al. ..... 404/75

* cited by examiner

METHOD FOR ADDING FOAMING AGENTS TO PAVEMENT AGGREGATE

BACKGROUND OF THE INVENTION

The present invention relates to road reconstruction equipment and, more particularly, to a method for depositing pavement reconditioning materials on a roadway. Since their debut in the late 1960s and early 1970s, asphalt milling machines have been considered one of the major innovations in road reconstruction. Asphalt milling machines were originally designed to remove a top layer of deteriorated asphalt so a new layer of asphalt could be overlaid on the exposed underlayer. The resulting pavement was superior to simply overlaying a new layer of asphalt directly onto the old and deteriorated asphalt.

One significant benefit of asphalt milling machines that has emerged modernly is the ability to break up asphalt into recyclable-sized fragments. As recycling of all types has become more popular, asphalt milling machines have similarly increased in popularity.

One core component of most modern asphalt milling machines is the cutting element. Most cutting elements incorporate numerous cutting teeth to cut or tear into the road surface. In cutting elements comprising a generally cylindrical drum, the rotational axis of the drum is frequently positioned parallel to the road surface and the drum is rotated while being driven along the road surface in a direction transverse to its axis of rotation. Conventional cutting drums mill the asphalt in an upward direction, or an "up-cut" direction. However, some cutting drums may permit "down-cutting" to control "slabbing," and facilitate pulverizing and mixing.

Due to the abrasive nature of pavement, the cutting teeth traditionally wear out quickly and require frequent replacement. The replacement process may create significant downtime and hinder the overall efficiency of the milling process. Consequently, considerable effort has been expended to accelerate the replacement process and to increase the durability of the cutting teeth. Many newer cutting teeth, for example, are coupled to the cutting drum using various bolt-on housings to enable faster replacement.

U.S. patent application Ser. Nos. 11/164,947; 11/163,615; and 11/070,411 to Hall et al., which are all herein incorporated be reference for all that they contain, disclose systems to milling and repaving paved surfaces in situ.

BRIEF SUMMARY OF THE INVENTION

In one aspect of the invention, a method for reconditioning a paved surface includes the steps of providing a vehicle adapted to traverse the paved surface; providing a layer of loose aggregate on a underlayer by degrading the paved surface with a degradation element attached to the vehicle; adding a foaming agent to the layer of loose aggregate on the underlayer; and coating a total aggregate surface area by mixing hot asphalt into the loose aggregate and allowing the foaming agent to expand the asphalt. The layer of pavement aggregate may be consistent with incorporation into a wearing surface, a road base, a road sub-base, a drive way, a parking lot or combinations thereof. The degradation element in the step of providing a layer of loose aggregate may comprise at least one vertical milling apparatus.

The foaming agent may comprise azodicarbonamide, inorganic carbonates, organic acids, polycarbonic acid, organic salts, inorganic oxides, zinc, potassium, water, glycerol, stearate, hydrocarbons, nucleating agents, antioxidants, pigments, fire-retardants, or combinations thereof. It may have a characteristic of having a foaming half-life of 5-180 seconds. The foaming agent may foam at its decomposition threshold, which may be between 200 to 350 degrees Fahrenheit. The step of mixing at least one foaming agent with the loose aggregate may occur at a temperature below the foaming agent's decomposition threshold. Hot asphalt may bond the layer of pavement aggregate to an underlayer of the paved surface.

The method may further include a step of softening the paved surface by heating it before the step of degrading the paved surface. The method may further comprise a step of compacting the aggregate while coating the total aggregate surface area. The method may further comprise a step of fogging the pavement surface and/or loose aggregate with foaming agent using a fogger attached to the vehicle. The method may further comprise a step of mixing at least one foaming agent with at least one other component before adding the resulting mixture to the loose aggregate. The other component may be selected from the group consisting of water, liquids, gases, polymers, clays, waxes, oil based substances, zeolites, and combinations thereof.

The foaming agent may be added to the pavement and/or loose aggregate by a dispenser. The foaming agent may be directed towards the loose aggregate by an opening of a channel attached to the vehicle that connects the opening to at least one supply of a foaming agent. The channel may be adapted to vibrate, rotate, shake, move, or oscillate. The opening of the channel may be protected by a superhard material. The opening may comprise a nozzle. The opening in the channel may be positioned below the surface of the loose aggregate while adding the foaming agent.

In one aspect of the invention, a method comprises the steps of providing a vehicle adapted to traverse an area comprising a layer of pavement aggregate, wherein the vehicle comprises a first channel that precedes a second channel in the direction of motion of the vehicle, and wherein the first channel is in communication with at least one supply of foaming agent and the second channel is in communication with at least one supply of hot asphalt; positioning the first channel and the second channel so that at least a portion of each channel is disposed within the layer; adding the foaming agent into the layer from an opening in the first channel positioned below the surface of the layer; and adding hot asphalt into the layer from an opening in the second channel positioned below the surface of the layer.

DETAILED DESCRIPTION OF THE INVENTION AND THE PREFERRED EMBODIMENT

In this application, "pavement" or "paved surface" refers to any artificial, wear-resistant surface that facilitates vehicular, pedestrian, or other form of traffic. Pavement may include composites containing oil, tar, tarmac, macadam, tarmacadam, asphalt, asphaltum, pitch, bitumen, minerals, rocks, pebbles, gravel, polymeric materials, sand, polyester fibers, Portland cement, petrochemical binders, or the like. Likewise, reconditioning materials refer to any of various binders, oils, and resins, and foaming agents including bitumen, Celogen 780, azodicarbonamide, zinc, potassium, water, glycerol, stearate, hydrocarbons, nucleating agents, antioxidants, pigments, fire-retardants, surfactant, polymeric materials, emulsions, asphalt, tar, cement, oil, pitch, maltenes, zeolite, wax, or the like. Reference to aggregates refers to rock, crushed rock, gravel, sand, slag, soil, cinders, minerals, or other course materials, and may include both new aggregates and aggregates reclaimed from an existing roadway. Likewise, the term "degrade" or "degradation" is used in this application to mean milling, grinding, cutting, ripping apart, tearing apart, or otherwise taking or pulling apart a pavement material into smaller constituent pieces.

Figure 1:
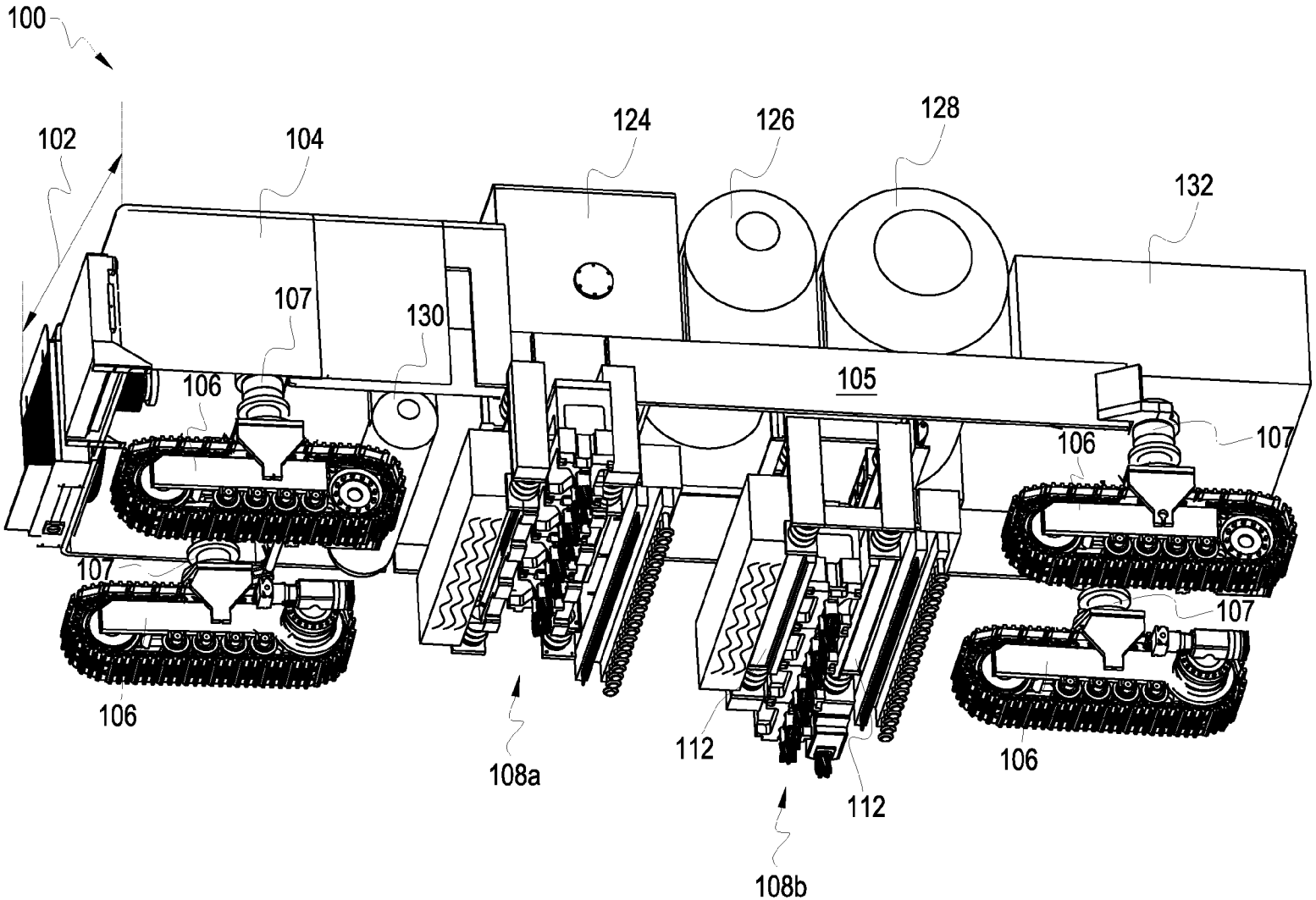
FIG. 1 is a perspective view illustrating an embodiment of a pavement recycling machine.

Referring to FIG. 1, in selected embodiments, a pavement recycling machine 100 may include a shroud 104, covering various internal components of the pavement recycling machine 100, a frame 105, and a translation mechanism 106 such as tracks, wheels, or the like, to translate or move the machine 100, such translation mechanisms being well known to those skilled in the art. The pavement recycling machine 100 may also include means 107 for adjusting the elevation and slope of the frame 105 relative to the translation mechanism 106 to adjust for varying elevations, slopes, and contours of the underlying road surface.

In selected embodiments, to facilitate degradation of a swath of pavement wider than the pavement recycling machine 100, the recycling machine 100 may include two or more support assemblies 108*a*, 108*b* that are capable of extending beyond the outer edge of the pavement recycling machine 100. Because the support assemblies 108*a*, 108*b* may be as wide as the vehicle itself, the extended support assemblies 108*a*, 108*b* may sweep over a width approximately twice the vehicle width 102.

To extend the support assemblies 108*a*, 108*b* beyond the outer edge of the pavement recycling machine 100, each of the support assemblies 108*a*, 108*b* may include actuators 112, such as hydraulic cylinders, pneumatic cylinders, or other mechanical devices known to those of skill in the art, to move the assemblies 108*a*, 108*b* to each side of the machine 100. Each support assembly 108*a*, 108*b* may also include a rake to level, smooth, and mix pavement aggregates, including new aggregates and reclaimed aggregates generated by pavement degradation tools.

Under the shroud 104, the pavement recycling machine 100 may include an engine and hydraulic pumps for powering the translation mechanism 106, the support assemblies 108*a*, 108*b*, the pavement degradation tools, or other components. Likewise, the pavement recycling machine 100 may include a tank 124 for storing hydraulic fluid, a fuel tank 126, a tank 128 for storing a first supply of reconditioning materials such as asphalt, bitumen, oil, tar, or the like, another tank 130 for storing a second supply of reconditioning material, such as a foaming agent, and a hopper 132 for storing aggregate such as gravel, rock, sand, pebbles, macadam, concrete, or the like.

Figure 2:
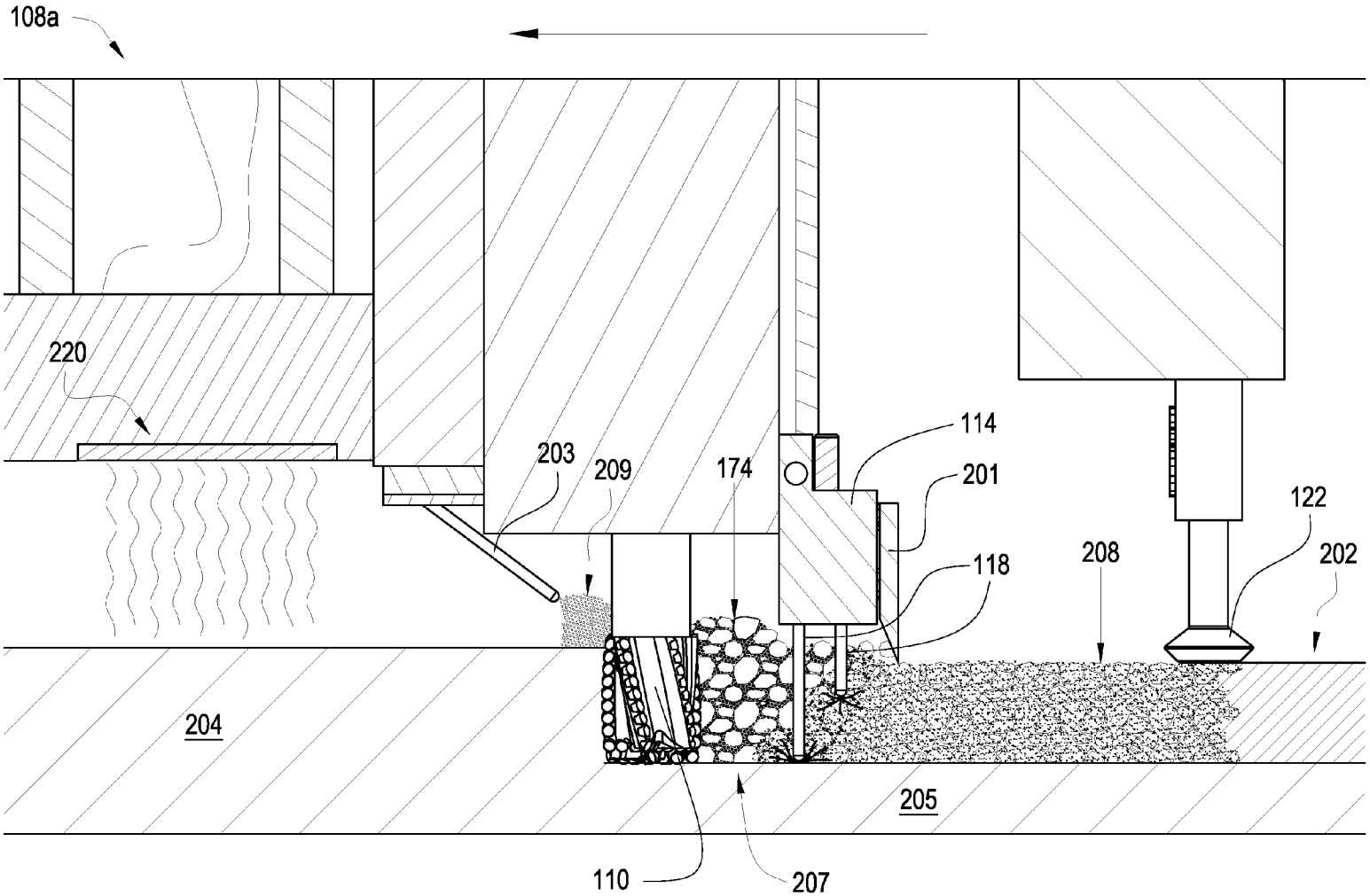
FIG. 2 is a cross-sectional view of an embodiment of a pavement recycling machine reconditioning a road surface.

Referring now to FIG. 2, the support assemblies 108*a*, 108*b* may include banks of pavement degradation tools 110 that rotate about an axis substantially normal to a plane defined by a paved surface. Each of these pavement degradation tools 110 may be used to degrade a paved surface in a direction substantially normal to their axes of rotation. The pavement degradation tools may comprise diamond. As a pavement recycling machine 100 moves forward in the direction of the arrow it may progressively degrade an asphalt surface 204 into loose pavement aggregate 174. A fogger 203 may add a foaming agent 209 to the layer loose aggregate 174 during or after it passes through the pavement degradation tools 110 to create an aggregate-foaming agent mixture 207. Although in the present embodiment the foaming agent 209 is added by a fogger 203, other types of dispenser may add the foaming agent 209 in a manner consistent with the present invention. A rake 114 may penetrate into and further blend the mixture 207. In some embodiments, the rake 114 may move side-to-side, front-to-back, in a circular pattern, vibrate, or the like to aid in mixing the aggregate 174 with the foaming agent 209. As illustrated, the rake 114 may comprise multiple injectors 118. In selected embodiments, each of the injectors 118 may be independently extended and retracted. This feature may allow selected injectors to be retracted to avoid obstacles such as manholes, grates, or other obstacles in the roadway.

In certain embodiments, each of the injectors 118 may be hollow to accommodate a flow of pavement reconditioning materials for deposit on a road surface. Pavement reconditioning materials may include, for example, foaming agent, asphalt, bitumen, tar, oil, water, combinations thereof, or other suitable materials, resins, and binding agents. In the present embodiment the foaming agent 209 is mixed into the loose aggregate 174 during the process of degradation. Subsequently, hot asphalt is added to the aggregate-foaming agent mixture 207 through one or more channels 118 to activate the foaming agent 209 and create a foaming mixture 208. Reconditioning materials may be mixed with various aggregates 174, including new aggregates and reclaimed aggregates generated by the pavement degradation tools 110. One feature of the present invention is that pavement reconditioning materials may be added to a layer of aggregate 174 below the surface of the layer. At least one injector 118 may comprise a special diamond tip that allows it to drag against surface of an underlayer 205 while injecting reconditioning materials into the layer. Staggered injectors 118 may contribute to a complete distribution of injected materials into the layer of loose aggregate 174. Additionally, injectors 118 positioned close to the surface of the underlayer may extrude hot asphalt that may serve to bond the underlayer 205 and the reconditioned pavement aggregate.

In certain embodiments, each support assembly 108*a*, 108*b* may include a screed 201 and a bank of one or more tampers 122. The screed 201 may be used to level the foaming mixture 208 and prepare it for compaction by a tamper 122 or other discrete elements such as vibratory rollers, and/or vibratory sleds. Once compacted, the new pavement 202 may be finished and sealed to provide protection against the elements, and tests on the pavement 202 may be performed to collect feedback on the recycling process. Like the injectors 118, the tampers 122 may, in certain embodiments, be independently extendable and retractable. In some embodiments of the invention a heater 220 may heat the road surface prior to degradation. This is believed to both decrease the wear on the degradation elements by softening the road surface, and to conserve the size of components of pavement aggregate 174.

Preferably the foaming agent 209 foams at a specific decomposition temperature threshold. This would allow the foaming agent to begin to foam only upon injection of a material at or above that temperature threshold, such as hot asphalt. By injecting hot asphalt into the aggregate-foaming agent mixture 207, the foaming action is believed to help the asphalt to coat the total surface area of the loose aggregate 174 as foamed material rises to the surface. The foaming agent 209 may comprise azodicarbonamide or other chemical foaming agents, zinc, potassium, water, glycerol, stearate, hydrocarbons, nucleating agents, antioxidants, pigments, fire-retardants, or combinations thereof Preferably the foaming agent 209 is Celogen 780 or a similar material, and is activated by hot asphalt. In some embodiments a wax such as Sasobit® may be incorporated into the reconditioning materials to lower the viscosity of the reconditioning material and aggregate mixture. At lower temperatures below its melting point the wax may freeze and afford additional mechanical strength to the new pavement 202.

The foaming mixture 208 is believed to have a significantly reduced viscosity compared to the aggregate-foaming agent mixture 207, which may allow the reconditioning materials to be more easily mixed with the aggregate 174. The foaming mixture 208 may also expand to saturate and permeate the aggregate 174. The resulting "foamed asphalt," may provide several significant advantages when performing in situ, pavement recycling. For example, it is reported that some foamed asphalt may increase the shear strength of the resulting paved surface, while reducing its susceptibility to moisture. The strength of foamed asphalt may approach that of cemented materials, while being more flexible and fatigue resistant than cemented materials.

Furthermore, when performing cold or warm mix processes, this foaming technique may allow the foaming agent to be mixed with a wider variety of aggregates. Foamed asphalt may also require less binder and water than other methods of cold mixing, which reduces binder and transportation costs. Foamed asphalt can also be compacted and used immediately upon deposit to the road surface, thereby saving time and money. Furthermore, this technique conserves energy because only the asphalt requires heating; the aggregates may be mixed while cold or damp. In the preferred embodiment, the asphalt is heated to between 200 to 350 degrees Fahrenheit prior to adding it to the aggregate-foaming agent mixture 207.

Other advantages include reported environmental benefits. The foaming technique reduces environmental harm that may occur from the evaporation of volatiles from the asphalt mix because curing generally does not release volatiles into the environment. According to some reports, foamed asphalt may also be stockpiled without binder runoff or leeching. Foamed asphalt may be deposited in adverse weather conditions, such as cold temperatures or light rain, without changing the characteristics or quality of the material.

Figure 3:
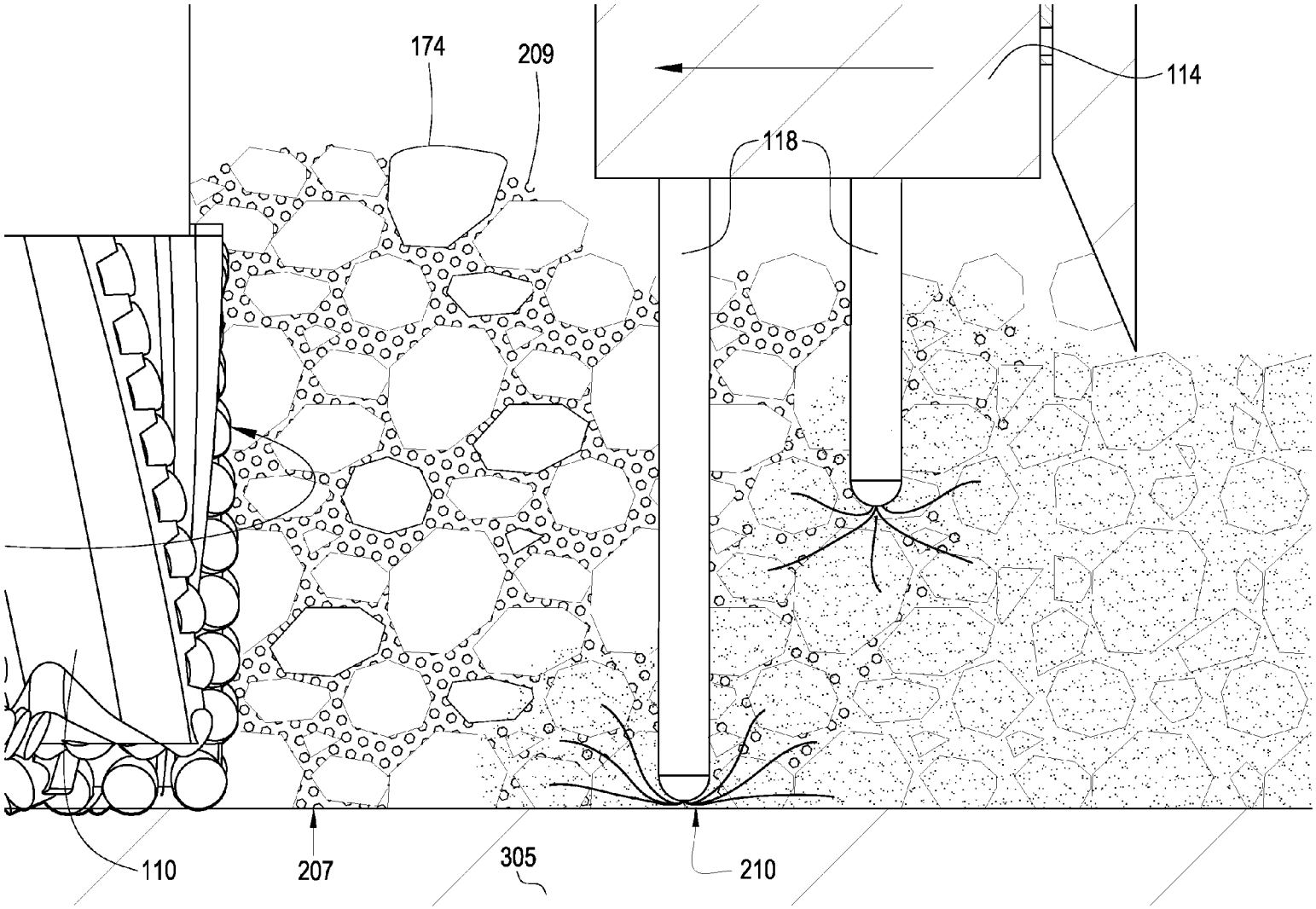
FIG. 3 is a cross-sectional view of an embodiment of a mixture of paving materials in the process of reconditioning a road surface.

Referring now to FIG. 3, an enlarged cross-sectional view of aggregate mixtures is shown. A pavement recycling machine moves in the direction of motion 305. Loose aggregate 174 is shown resulting from the action of degradation elements 110. A foaming agent 209 is added and mixed into the loose aggregate, preferably during the process of degradation. The resulting aggregate-foaming agent mixture 207 may foam only once activated by a hot asphalt 210, or another hot reconditioning material As previously mentioned, a rake 114 may comprise multiple injectors 118. The injectors 118 may extrude hot asphalt 210 or other hot reconditioning materials. The injectors 118 may extend from the rake 114 to varying depths in the layer of aggregate 174. With injectors 118 at different depths, the hot asphalt may flow out and distribute throughout the layer of loose aggregate 174. The injectors 118 may be raised and lowered as specific circumstances may require. In some embodiments a nozzle may fog or spray fresh reconditioning materials onto the surface of the foaming mixture 208 to ensure adequate surface coating. In some embodiments the injectors 118 may comprise sensors that detect the amount of reconditioning materials being dispersed into the aggregate 174 and appropriate settings on the height and flow of the injectors 118 and nozzle may be adjusted accordingly to obtain maximum efficiency.

In some embodiments the foaming agent 209 may be mixed with another component from another source. In some embodiments the foaming agent 209 may be Celogen 780 or another similar substance. The other component may be selected from the group consisting of water, liquids, gases, polymers, clays, waxes, oil based substances, zeolites, and combinations thereof. In some embodiments a fogger may pre-treat the paved surface or loose aggregate with a rejuvenating fog. As the pavement recycling machine 100 moves forward, a rejuvenating fog may comprise a mixture of maltenes and serve a number of purposes. For example, the rejuvenating fog may wet the aggregate 174 to allow better adhesion to additional reconditioning material that may be added later, act as a dust suppressant, and restore maltene content in the original aggregate 174 that may have been lost due to wear and tear on the road.

Figure 4:
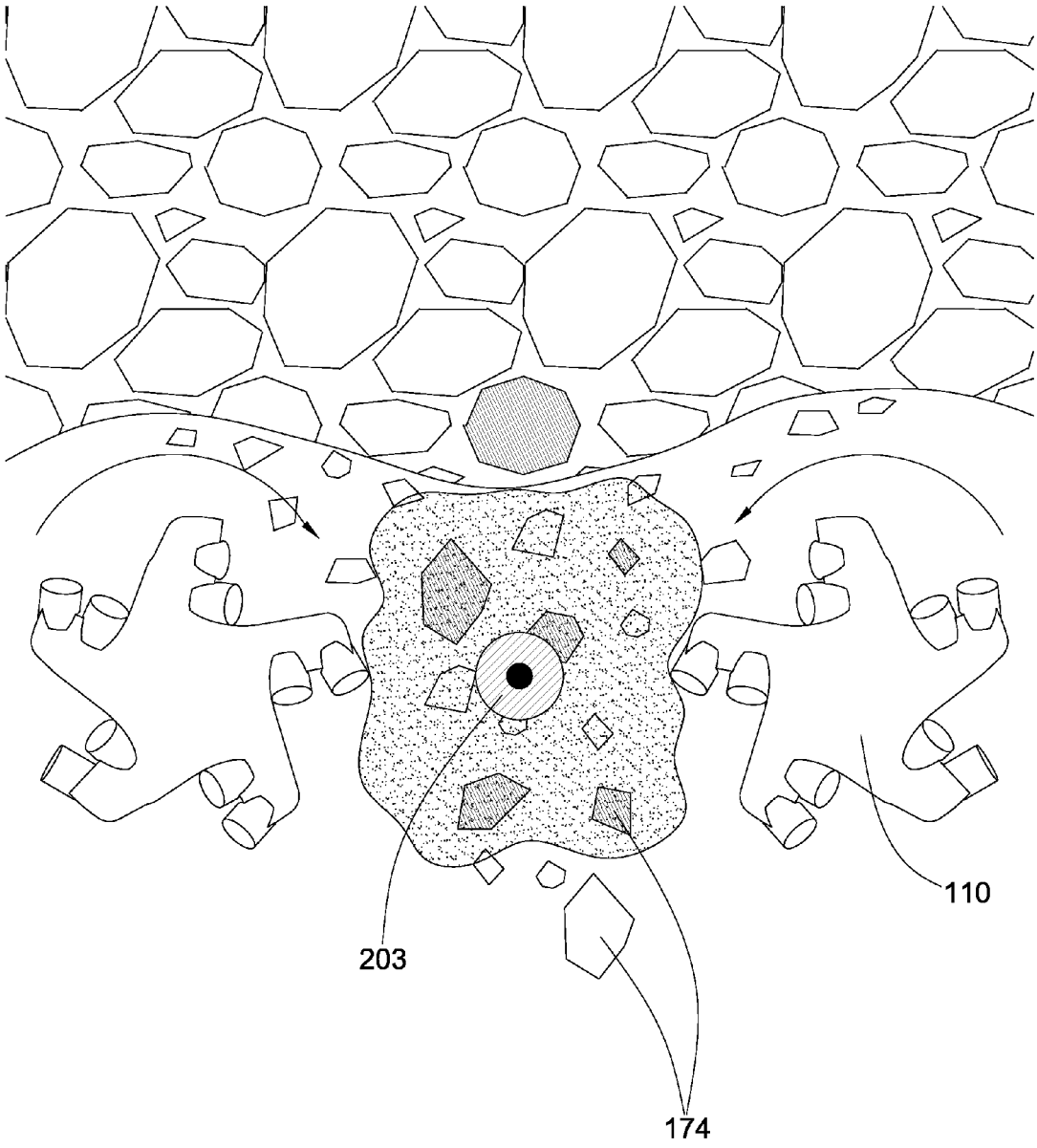
FIG. 4 is a cross-sectional view of an embodiment of a fogger depositing foaming agent onto paving materials.

Referring now to FIG. 4, the pavement degradation tools 110, may spin in opposing directions, thereby helping to mix the foaming agent 209 into the aggregate 174 recovered from the degradation of the original pavement surface 204. The pavement degradation tools 110 may move side to side as the pavement recycling machine moves forward into the original pavement surface 204. Each tool 110 may also be able to move up and down individually to avoid obstacles such as manholes. Although the present embodiment depicts a fogger 203 dispensing the foaming agent 209, embodiments of the invention may comprise one or more of various kinds of dispensers.

Figure 5:
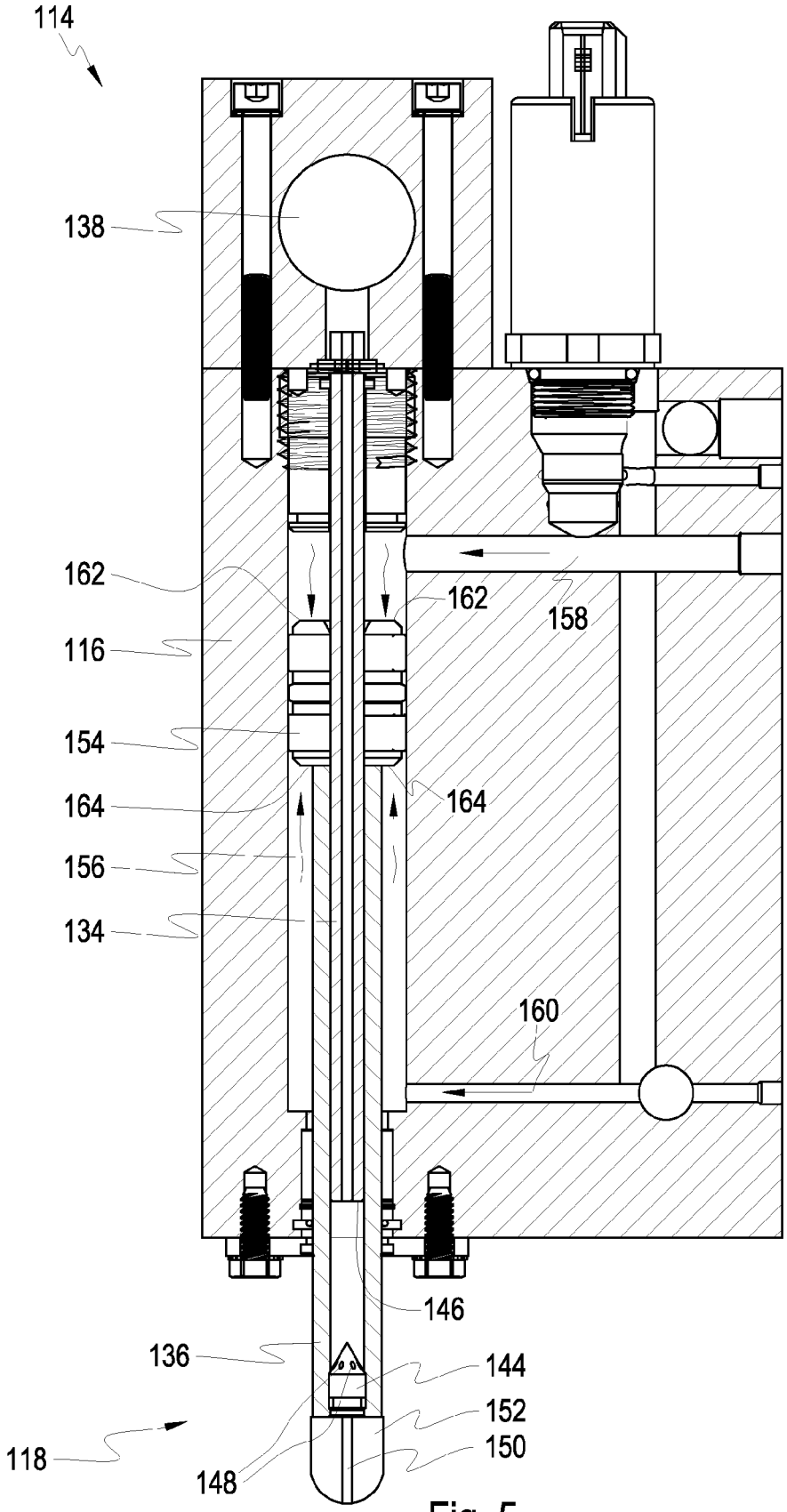
FIG. 5 is a cross-sectional view of an embodiment of an injector.

Referring now to FIG. 5, an injector 118 may comprise a first channel 134 in communication with the supply of foaming agent or hot asphalt provided by the duct 138. The outside diameter of the first channel may slide inside a second channel 136 thereby transmitting the supply of pavement reconditioning materials into the second channel 136. In certain embodiments, the first channel 134 may remain relatively fixed with respect to the housing 116, while the second channel 136 may extend and retract (downward in the illustrated embodiment) with respect to the first channel 134 and the rake 114. A seal may be provided between the first channel 134 and the second channel 136 to prevent leakage of reconditioning materials where the two channels 134, 136 interface.

A blocking element 144 may be coupled to the second channel 136. In the illustrated embodiment, the blocking element 144 has a conical shape although other shapes are possible and within the scope of the invention. The second channel 136 may slide upward with respect to the first channel 134, the blocking element 144 may contact a seat 146 coupled to the first channel 134. The blocking element 144 and the seat 146 together form a valve 144, 146. Upon contacting the seat 146, the blocking element 144 seals off the first channel 134, thereby cutting off the flow of reconditioning materials. Thus, when the injector 118 is retracted (i.e., slid upward), the flow of pavement reconditioning materials is cut off. Conversely, when the injector 118 is extended, the valve 144, 146 opens and re-initiates the flow of reconditioning materials. As shown, the blocking element 144 may include one or more passageways 148 to accommodate a flow of pavement reconditioning materials when the valve 144, 146 is open. These passageways 148 may connect to an opening 150 for depositing the pavement reconditioning materials on a road surface.

A hardened tip 152 may be coupled to the second channel 136 to provide added durability to the injector 118 and to resist the abrasive effects of pavement materials (i.e., rock, gravel, concrete, etc.) in the road surface. For example, in certain embodiments, the hardened tip 152 may be coated with diamond, boron nitride, cemented metal carbide, or combinations mixtures, or alloys thereof, to provide added durability. A hardened tip may also reduce wear and/or corrosion.

In some embodiments of the present invention, a nozzle may be fitted within the opening 150 for depositing the pavement reconditioning materials on a road surface. The nozzle may increase the pressure exerted on the pavement reconditioning materials as they exit the opening 150. The nozzle may also increase the temperature and pressure of the pavement reconditioning material immediately before the reconditioning material exits the opening 150, which may allow reconditioning material to be heated to a higher temperature before they are deposited. The nozzle may also comprise a particular pattern which may help deposit the reconditioning material in a specific desired manner. Individual injectors 118 may comprise a nozzle with a different pattern such that the injectors near the end of the swath of pavement may deposit the reconditioning material differently than the injectors that are positioned near the middle of the same swath of pavement.

To extend and retract the injector 118, a piston 154 may be coupled to the second channel 136 and slide with respect to the first channel 134. The first channel 134 may slide through a bore in the piston 154. The rake 114 may comprise a chamber 156 to accommodate the travel of the piston 154. In certain embodiments, the piston 154 may be driven by hydraulic fluid supplied under pressure to the chamber 156, although it is contemplated that pressurized air or other fluids could also be used. In one embodiment, hydraulic fluid may be supplied to the chamber 156 through a pair of passageways 158, 160 in the rake 114. Hydraulic fluid supplied under pressure through a first passageway 158 may exert force on a first surface 162 of the piston 154, while hydraulic fluid supplied under pressure through a second passageway 160 may exert force on a second surface 164 of the piston 154. Because the second channel 136 may connect to one end of the piston 154, the area of the first surface 162 may be larger than the area of the second surface 164. Thus, by applying equal hydraulic pressure to each of the first and second surfaces 162, 164, the piston 154 will be urged downward due to the greater area of the surface 162.

Figure 6:
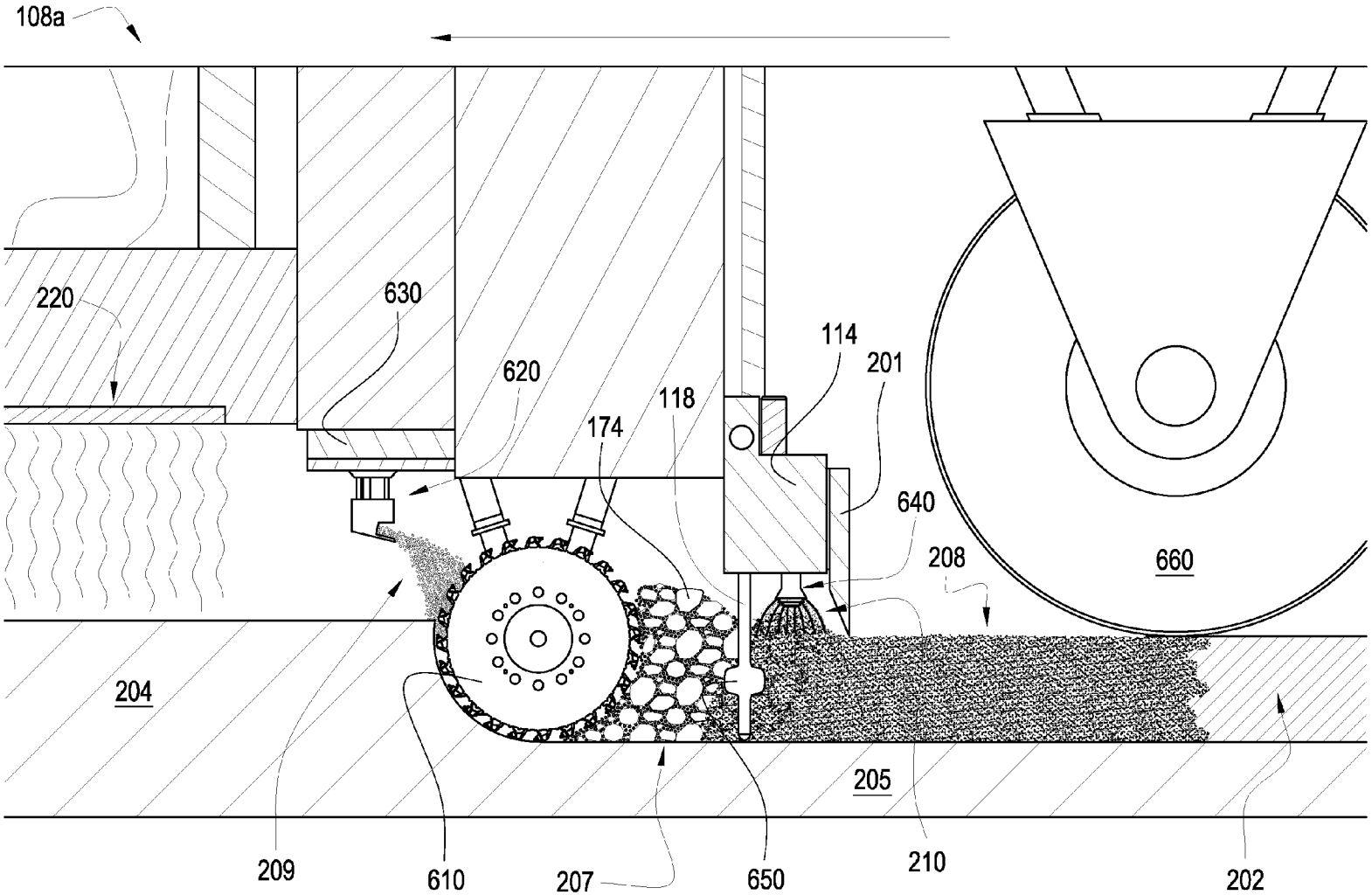
FIG. 6 is a cross-sectional view of another embodiment of a pavement recycling machine reconditioning a road surface.

Referring now to FIG. 6, another embodiment of a pavement recycling machine 100 is disclosed, in which a degradation drum 610 is used. The degradation drum 610 may comprise cutting surfaces that may comprise diamond, cubic boron nitride, silicon carbide, tungsten, carbide, hard metals, and combinations thereof. As the recycling machine 100 moves in the direction indicated by the arrow, a heater 220 may heat the original paved surface 204 in order to loosen the pavement 204 and to preserve the original size of the aggregate 174. A dispenser 620 may be connected to a reservoir 630 of foaming agent 209 or pavement reconditioning materials. The dispenser 620 or an element within the dispenser 620 may spin, thereby projecting the foaming agent 209 towards the degradation drum 610 and the newly loosened aggregate 174. This process is believed to mix the loose aggregate 174 with the foaming agent 209 during the process of degradation, thereby efficiently producing a mixture of aggregate and foaming agent.

A spray nozzle 640 may be disposed on the rake 114, and may be connected to a supply of hot asphalt 210 or another hot pavement reconditioning material. In some embodiments of the invention the spray nozzle 640 may be disposed on the pavement recycling machine 100 but not on the rake 114. Although the present embodiment depicts a spray nozzle 640 pointed straight down at the aggregate 174, the spray nozzle 640 may be directed at an angle or towards the degradation element 610. It is believed that in some embodiments that foaming may occur as the spray nozzle 640 directs foaming agent towards the rotating degradation drum 610.

In some embodiments a channel 118 may extend from the rake 114 and into the aggregate 174. The channel 118 may comprise an opening through which it may extrude hot asphalt 210 or other pavement reconditioning materials. The opening may be disposed close to a surface of the sublayer 205. The channel may comprise fins 650 and may spin or vibrate. It is believed that the presence of fins 650 and spinning or vibratory motion may help to mix the aggregate 174 and may help to form a layer of foaming aggregate 208. As previously described a screed 201 may level the foaming aggregate 208 and prepare it for compaction. The present embodiment discloses a roller 660 used to compact the foaming aggregate 208. Once compacted, the foaming aggregate 208 may form a layer of new pavement 202. The new pavement 202 may be finished and sealed to provide protection against the elements, and tests on the pavement 202 may be performed to collect feedback on the recycling process.

Figure 7:
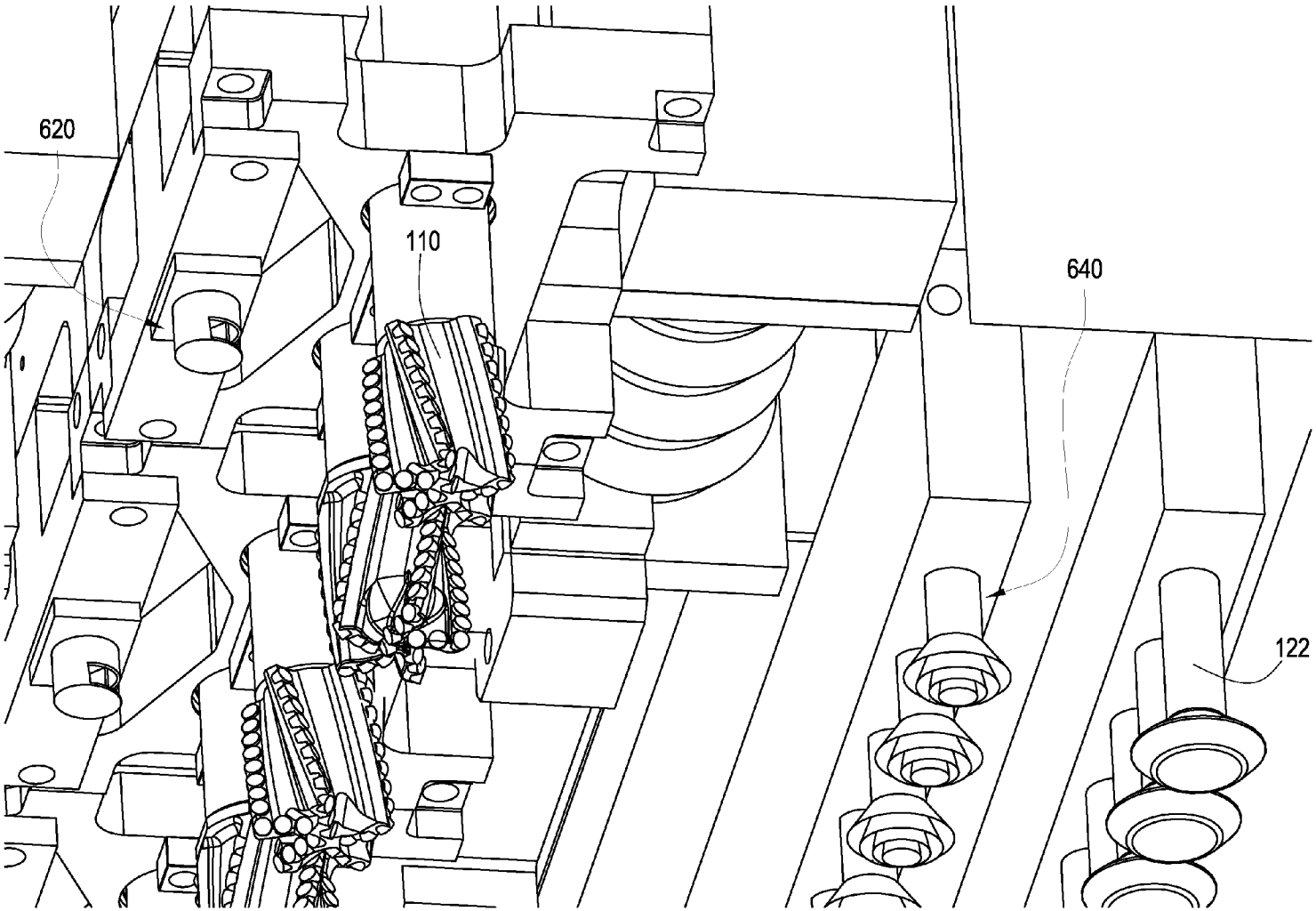
FIG. 7 is a perspective view of an embodiment of pavement recycling tools on a recycling machine.

Referring now to FIG. 7, a perspective view of another embodiment of a recycling machine 100 is disclosed. The present embodiment employs a plurality of dispensers 620 and a plurality of spray nozzles 640, consistent with the dispenser 620 and spray nozzle 640 disclosed in FIG. 6. In the present embodiment the plurality of dispensers 620 and the plurality of spray nozzles 640 are incorporated into a recycling machine 100 which also comprises degradation elements 110 and tampers 122 consistent with the those disclosed in FIG. 2. Although specific combinations of degradation elements, foaming agent dispensers, nozzles, and channels have been described in this application any combination of these components may be consistent with the present invention.

Figure 8:
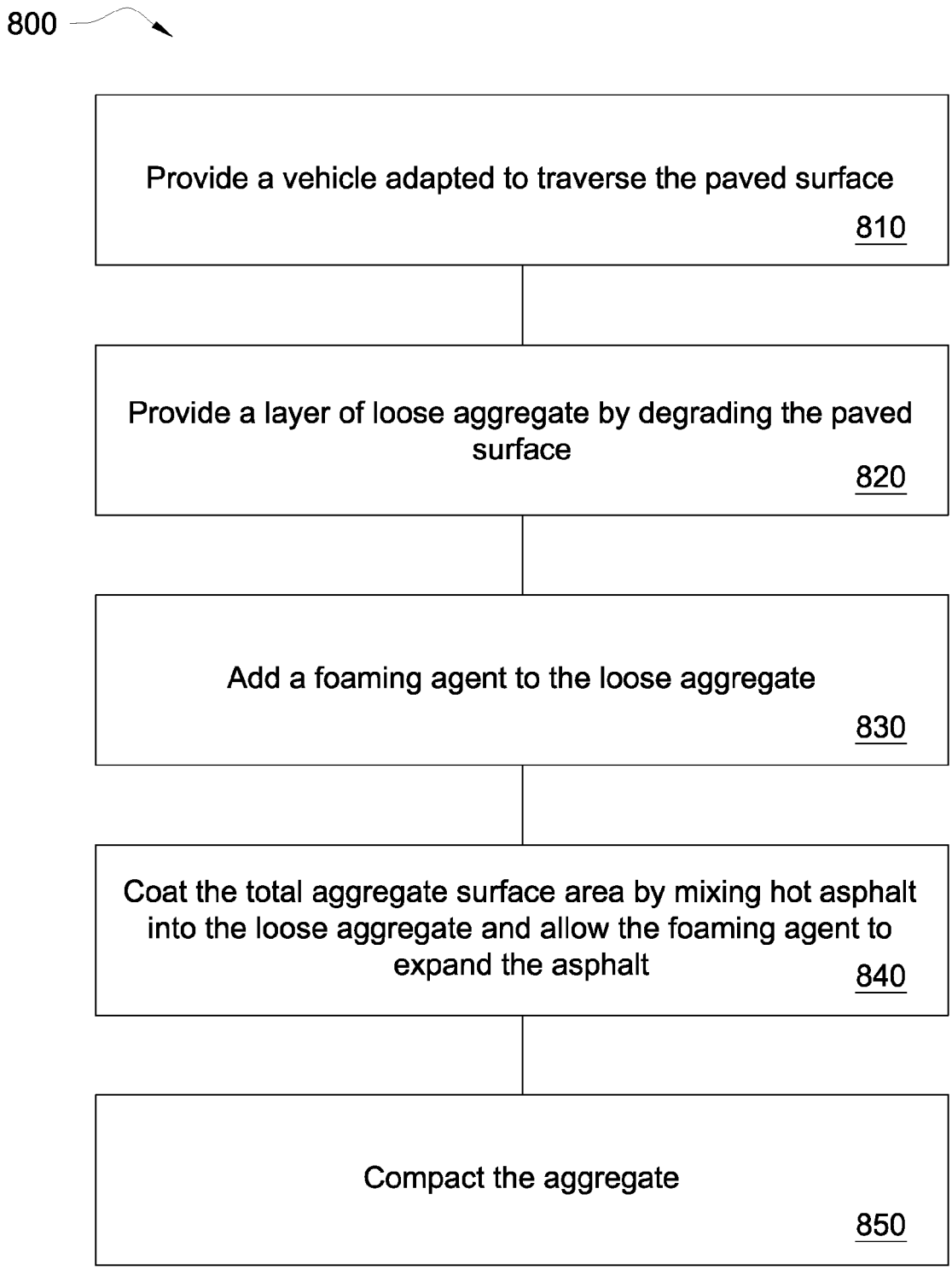
FIG. 8 is a flowchart illustrating an embodiment of a method of reconditioning a paved surface.

Referring now to FIG. 8, as previously mentioned, the asphalt recycling process described in the previous figures may be characterized by a method 800 for reconditioning a paved surface. The method 800 includes a step 810 of providing a vehicle adapted to traverse the paved surface. The method further includes a step 820 of providing a layer of loose aggregate on an underlayer by degrading the paved surface with a degradation element attached to the vehicle and a step 830 of adding a foaming agent to the layer of loose aggregate on the underlayer. The method comprises a subsequent step 840 of coating a total aggregate surface area by mixing hot asphalt into the loose aggregate and allowing the foaming agent to expand the asphalt. The method 800 may comprise a finishing step 850 of compacting the aggregate. Final steps may also be taken such as sealing and finishing the roadway and collecting data on the finished roadway. Although specific steps of the method 800 are shown, this may not be construed to indicate that other steps may not be compatible with and inclusive into the method shown.

Whereas the present invention has been described in particular relation to the drawings attached hereto, it should be understood that other and further modifications apart from those shown or suggested herein, may be made within the scope and spirit of the present invention.

What is claimed is:

1. A method for reconditioning a paved surface; comprising:

providing a vehicle adapted to traverse the paved surface;

providing a layer of loose aggregate on an underlayer by degrading the paved surface with a degradation element attached to the vehicle;

adding a foaming agent to the layer of loose aggregate on the underlayer; and coating a total aggregate surface area by mixing hot asphalt into the loose aggregate and allowing the foaming agent to expand the asphalt.

2. The method of claim 1, wherein the foaming agent comprises azodicarbonamide inorganic carbonates, organic acids, polycarbonic acid, organic salts, inorganic oxides, zinc, potassium, water, glycerol, stearate, hydrocarbons, nucleating agents, antioxidants, pigments, fire-retardants, or combinations thereof.

3. The method of claim 1, wherein the foaming agent foams between 200 to 350 degrees Fahrenheit.

4. The method of claim 1, wherein the step of mixing at least one foaming agent with the loose aggregate occurs at a temperature below the foaming agent's decomposition threshold.

5. The method of claim 1, wherein the foaming agent has a characteristic of having a foaming half-life of 5-180 seconds.

6. The method of claim 1, wherein the method further includes a step of softening the paved surface by heating it before the step of degrading the paved surface.

7. The method of claim 1, wherein the degradation element in the step of providing a layer of loose aggregate comprises at least one vertical milling apparatus.

8. The method of claim 1, wherein the layer of pavement aggregate is consistent with incorporation into a wearing surface, a road base, a road sub-base, a drive way, a parking lot or combinations thereof.

9. The method of claim 1, wherein the method further comprises a step of compacting the aggregate while coating the total aggregate surface area.

10. The method of claim 1, wherein the method further comprises a step of fogging the pavement surface and/or loose aggregate with foaming agent using a fogger attached to the vehicle.

11. The method of claim 1, wherein hot asphalt bonds the layer of pavement aggregate to an underlayer of the paved surface.

12. The method of claim 1, wherein the method further comprises a step of mixing at least one foaming agent with at least one other component before adding the resulting mixture to the loose aggregate.

13. The method of claim 12, wherein the other component comprises material selected from the group consisting of water, liquids, gases, polymers, clays, waxes, oil based substances, zeolites, and combinations thereof.

14. The method of claim 1, wherein the foaming agent is added to the pavement and/or loose aggregate by a dispenser.

15. The method of claim 1, wherein the foaming agent is directed towards the loose aggregate by an opening of a channel attached to the vehicle that connects the opening to at least one supply of foaming agent.

16. The method of claim 14, wherein the opening of the channel is protected by a superhard material.

17. The methods of claim 14, wherein the channel is adapted to vibrate, rotate, shake, move, or oscillate.

18. The method of claim 14, wherein the opening comprises a nozzle.

19. The method of claim 14, wherein the opening in the channel is positioned below the surface of the loose aggregate while adding the foaming agent.

* * * * *